US009837705B2

(12) United States Patent
Aizawa et al.

(10) Patent No.: US 9,837,705 B2
(45) Date of Patent: Dec. 5, 2017

(54) ELECTRONIC APPARATUS

(71) Applicant: Seiko Epson Corporation, Tokyo (JP)

(72) Inventors: Tadashi Aizawa, Matsumoto (JP); Masayuki Ikeda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/822,674

(22) Filed: Aug. 10, 2015

(65) Prior Publication Data

US 2016/0049721 A1 Feb. 18, 2016

(30) Foreign Application Priority Data

Aug. 13, 2014 (JP) ..... 2014-164704

(51) Int. Cl.

| | |
|---|---|
| ***H01Q 1/27*** | (2006.01) |
| ***H01Q 1/24*** | (2006.01) |
| ***G04G 21/04*** | (2013.01) |
| ***G04R 60/10*** | (2013.01) |
| ***H01Q 7/00*** | (2006.01) |

(52) U.S. Cl.

CPC ..... *H01Q 1/273* (2013.01); *G04G 21/04* (2013.01); *G04R 60/10* (2013.01); *H01Q 1/241* (2013.01); *H01Q 7/00* (2013.01)

(58) Field of Classification Search

CPC ..... H01Q 1/273; H01Q 1/241; G04G 21/04; G04R 60/10

USPC ..... 343/718

See application file for complete search history.

(56) References Cited

U.S. PATENT DOCUMENTS

| | | | | |
|---|---|---|---|---|
| 7,532,164 | B1 * | 5/2009 | Phillips | H01Q 9/0428 343/700 MS |
| 2013/0051181 | A1 * | 2/2013 | Fujisawa | G04R 20/02 368/14 |
| 2014/0225786 | A1 | 8/2014 | Lyons et al. | |
| 2014/0240181 | A1 | 8/2014 | Mamuro et al. | |
| 2014/0253394 | A1 * | 9/2014 | Nissinen | H01Q 7/00 343/702 |

FOREIGN PATENT DOCUMENTS

| | | | |
|---|---|---|---|
| JP | 59-012601 | A | 1/1984 |
| JP | 2000-059241 | A | 2/2000 |
| JP | 2013-183437 | A | 9/2013 |
| JP | 2013-214940 | A | 10/2013 |

* cited by examiner

*Primary Examiner* — Dameon E Levi
*Assistant Examiner* — David Lotter
(74) *Attorney, Agent, or Firm* — Kilpatrick Townsend & Stockton LLP

(57) ABSTRACT

An electronic apparatus includes a display; and an antenna including a first element without power feeding that is a structural component made of metal and is disposed on the display or above a display surface of the display in a display direction, a second element which is disposed below the first element and is connected to a power supply, and a GND plate that is disposed below the second element, wherein the first element and the second element are electromagnetically coupled.

26 Claims, 10 Drawing Sheets

DIRECTIVITY OF X-Z PLANE

DIRECTIVITY OF Y-Z PLANE

ELECTRONIC APPARATUS

This application claims priority to Japanese Patent Application No. 2014-164704, filed Aug. 13, 2014, the entirety of which is hereby incorporated by reference.

BACKGROUND

1. Technical Field

The present disclosure relates to an electronic apparatus having an antenna.

2. Related Art

In an electronic apparatus that performs mobile communication and reception of GPS radio waves, by using a satellite, it is preferable to use a circularly polarized wave antenna in order to reduce the reception sensitivity variation caused by a change in a polarization plane due to a change in the orientation of the antenna, or to improve the theoretical sensitivity by corresponding circularly polarized waves. For example, a technology is disclosed in which a ring antenna including an element with power feeding and a C-shaped element without power feeding formed on the surface of the dielectric is mounted on an electronic timepiece, as a circularly polarized wave antenna (for example, JP-A-2013-214940).

To make the ring antenna to function as a loop antenna, an antenna length of 1λ is theoretically required, but in JP-A-2013-214940, a wavelength shortening effect is achieved by using a dielectric and the actual antenna length is configured to be shorter than 1λ.

However, since the ring antenna uses a dielectric, the occupied volume of the antenna is large, and in the case where the antenna is built into an outer case, a timepiece becomes large. Therefore, depending on the type of timepiece, it is difficult to adopt the ring antenna.

Further, in the case of a thin timepiece, since a distance from the feeding point of the antenna to an element without power feeding is reduced, antenna performance is reduced even when employing the ring antenna.

Although it is conceivable to attach the ring antenna to the outer case, in this case, a conduction structure of the circuit board and the antenna is required. In addition, it also requires waterproofing measures for the conduction structure, and thus the structure becomes complicated or the cost is increased.

As an antenna used in an electronic timepiece, there is a patch type antenna in addition to the ring antenna. However, since this antenna also uses the dielectric, the occupied volume of the antenna is large. As a result, when the antenna is incorporated in the outer case similar to the ring antenna, there are constraints on a component layout, and it is not suitable for miniaturization and thinning of the timepiece. When the antenna is disposed in the outside of the outer case, the patch antenna is designed to be projected from the case, and the degree of freedom in design is smaller than the ring antenna.

SUMMARY

An advantage of some aspects of the disclosure is to provide an electronic apparatus including an antenna capable of resolving at least one of complication of the structure when the electrical equipment is miniaturized and thinned, a reduction in antenna performance, and constraints on the freedom of design.

An electronic apparatus according to this application example includes: a display; and an antenna including a first element without power feeding that is a structural component made of metal and is disposed on the display or above a display surface of the display in a display direction, a second element which is disposed below the first element and is connected to a power supply, and a GND plate that is disposed below the second element, wherein the first element and the second element are electromagnetically coupled and the equivalent electrical lengths of the first element and the second element are shorter than a ¼ wavelength.

This application example can receive radio waves by a second element having a length shorter than ¼ wavelength that constituting the antenna, a power supply connected to the second element, and the GND plate. However, in this application example, the structural component made of metal which is disposed above the second element in the display direction of the display is also used as a part of the antenna. In other words, it is possible to increase a distance from the GND plate to the receiving surface by using the structural component as the first element without power feeding and making the first element and the second element to be electromagnetically coupled, and thus the radiation efficiency of the antenna is improved. Further, since the structural component is used as a part of the antenna, that is, as the first element, only the second element and the power supply are required as an antenna dedicated member, and the volume of the antenna member is reduced as compared with the case where the structural component is not used as a part of the antenna.

An electronic apparatus according to this application example includes: a display; and an antenna including a first element without power feeding that is a structural component made of metal and is disposed on the display or above a display surface of the display in a display direction, a second element which is disposed below the first element and is connected to a power supply, and a GND plate that is disposed below the second element, wherein the first element and the second element are electromagnetically coupled and the first element is an annular shape.

In this application example, the structural component made of metal which is disposed above the second element in the display direction of the display is also used as a part of the antenna. In other words, it is possible to increase a distance from the GND plate to the receiving surface by using the structural component as the first element without power feeding and making the first element and the second element to be electromagnetically coupled, and thus the radiation efficiency of the antenna is improved. Further, since the structural component is used as a part of the antenna, that is, as the first element, only the second element and the power supply are required as an antenna dedicated member, and the volume of the antenna member is reduced as compared with the case where the structural component is not used as a part of the antenna. Further, since the first element is an annular shape, it is possible to reliably fix the glass member for covering the display. In addition, in this application example, "annular shape" is a concept including an annular shape of a square shape in addition to an annular shape of a circular shape. The same is applied to the following description.

An electronic apparatus according to this application example includes: an antenna including a GND plate, a first element made of a metal material, without power feeding, and a second element which is disposed between the first element and the GND plate and connected to the power supply; and a receiver connected to the antenna, wherein the first element and the second element are disposed so as to overlap each other when viewed from a direction perpendicular to a plane direction of the GND plate, and the first element and the second element are electromagnetically coupled and the equivalent electrical length of each of the first element and the second element is shorter than a ¼ wavelength.

This application example can receive radio waves by a second element having a length shorter than ¼ wavelength that constituting the antenna, a power supply connected to the second element, and the GND plate. However, in this application example, a first element without power feeding which has a length shorter than ¼ wavelength and is disposed so as to overlap the second element when viewed from a direction perpendicular to a plane direction of the GND plate is used as a part of the antenna. Since the first element and the second element are disposed so as to overlap each other when viewed from a direction perpendicular to a plane direction of the GND plate, the coupling becomes strong when they are electromagnetically coupled, and the radiation efficiency of the antenna is improved. Further, this arrangement enables the miniaturization of the electronic apparatus.

An electronic apparatus according to this application example includes: an antenna including a GND plate, a first element made of a metal material, without power feeding, and a second element which is disposed between the first element and the GND plate and connected to the power supply; and a receiver connected to the antenna, wherein the first element and the second element are disposed so as to overlap each other when viewed from a direction perpendicular to a plane direction of the GND plate, and the first element and the second element are electromagnetically coupled and the first element is an annular shape.

In this application example, when viewed from a direction perpendicular to a plane direction of the GND plate, a first element without power feeding that is disposed so as to overlap the second element is used as a part of the antenna. Since the first element and the second element are disposed so as to overlap each other when viewed from a direction perpendicular to a plane direction of the GND plate, the coupling becomes strong when they are electromagnetically coupled, and the radiation efficiency of the antenna is improved. Further, this arrangement enables the miniaturization of the electronic apparatus. Further, since the first element is an annular shape, for example, it is possible to reliably fix a glass member for covering the display.

In the electronic apparatus according to the application example described above, an equivalent electrical length after the first element and the second element may be electromagnetically coupled is ¼ wavelength. In this case, since the antenna includes a first element without power feeding, a second element which is power-fed by a power supply, the power supply, and a GND plate, an image antenna of a ¼ wavelength is formed in the GND plate, and the antenna 30 of the present embodiment operates in a ½ wavelength.

In the electronic apparatus according to the application example described above, an equivalent electrical length after the first element and the second element are electromagnetically coupled may be an integer multiple of ¼ wavelength. In this case, the reception of radio waves in a wide frequency band is performed.

In the electronic apparatus according to the application example described above, the first element and the second element may be disposed so as to overlap each other when viewed from a direction perpendicular to a plane direction of the GND plate. In this case, the electro-magnetic coupling between the first element and the second element becomes strong, and the radiation efficiency of the antenna is improved.

In the electronic apparatus according to the application example described above, the size of a maximum outer shape of the first element may be 20 mm or more to 30 mm or less, when viewed from a direction perpendicular to a plane direction of the GND plate, wherein the equivalent electrical length of the second element is ¼ wavelength× about 0.7. In this case, when the second element and the first element that is disposed above the second element in the display direction are electromagnetically coupled, the equivalent electrical length is ¼ wavelength, even in a small wristwatch having a diameter of approximately 20 to 30 mm, and an antenna is obtained which operates at ½ wavelength and for which the radiation efficiency is improved.

In the electronic apparatus according to the application example described above, the electronic apparatus may be a wristwatch, and the first element may be a bezel that is disposed in a case of the wristwatch. In this case, it is possible to increase a distance from the GND plate to the receiving surface by using the bezel as the first element without power feeding and making the first element and the second element to be electromagnetically coupled, and thus the radiation efficiency of the antenna is improved. Further, since the bezel is used as a part of the antenna, that is, as the first element, only the second element and the power supply are required as an antenna dedicated member, and the volume of the antenna member is reduced as compared with the case where the bezel is not used as a part of the antenna.

In the electronic apparatus according to the application example described above, the antenna may receive microwaves. In this case, not only the GPS radio waves, but also radio waves for a mobile phone, Wi-Fi (registered trademark), Bluetooth (registered trademark) or the like are well received.

In the electronic apparatus according to the application example described above, the second element may be a circular arc shape having a predetermined gap between one end and the other end of the second element. In this case, the antenna is provided which is capable of receiving circularly polarized waves and has improved radiation efficiency by the second element functioning as a loop antenna, and the electromagnetic coupling with the first element. In addition, as used herein, "arcuate" is a concept including not only a shape having a predetermined gap between the one end and the other end of the square-shaped element, but also the shape having a predetermined gap between one end and the other end of the annular shaped element.

In the electronic apparatus according to the application example described above, the first element may be an annular shape in which one end and the other end of the first element are in contact, or a circular arc shape similar to the second element and having a predetermined gap between one end and the other end of the first element. If the first element can be electromagnetically coupled with the second element, the shape is not particularly limited. However, if the shape of the first element is similar to the second element, the electromagnetic coupling becomes stronger. In addition, in this specification, an "annular shape" is a concept including an annular shape of a square shape as well as an annular shape of a circular shape.

In the electronic apparatus according to the application example described above, the structural component may be one of a bezel, a cover glass, a dial ring, and an alphabetical keypad. In this case, even in a small electronic apparatus in which the distance from the GND plate to the receiving surface cannot be sufficiently secured, the radiation efficiency is improved by sufficiently securing the distance from the GND plate to the receiving surface by using a structural component that has not been originally utilized as an antenna is used as a part of an antenna. Further, since a bezel, a cover glass, a dial ring, and the like, which are made of metal, are structural components disposed outside of the outer case, the plane size of the antenna is increased, and the reception performance is improved, as compared to an electronic apparatus in which the antenna is received in the inside of the outer case.

In the electronic apparatus according to the application example described above, the display may be a digital-type or a pointer-type. In this application example, regardless of the type of the display, it is intended to improve the radiation efficiency of the antenna by utilizing the first element that is the structural component as a part of the antenna.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
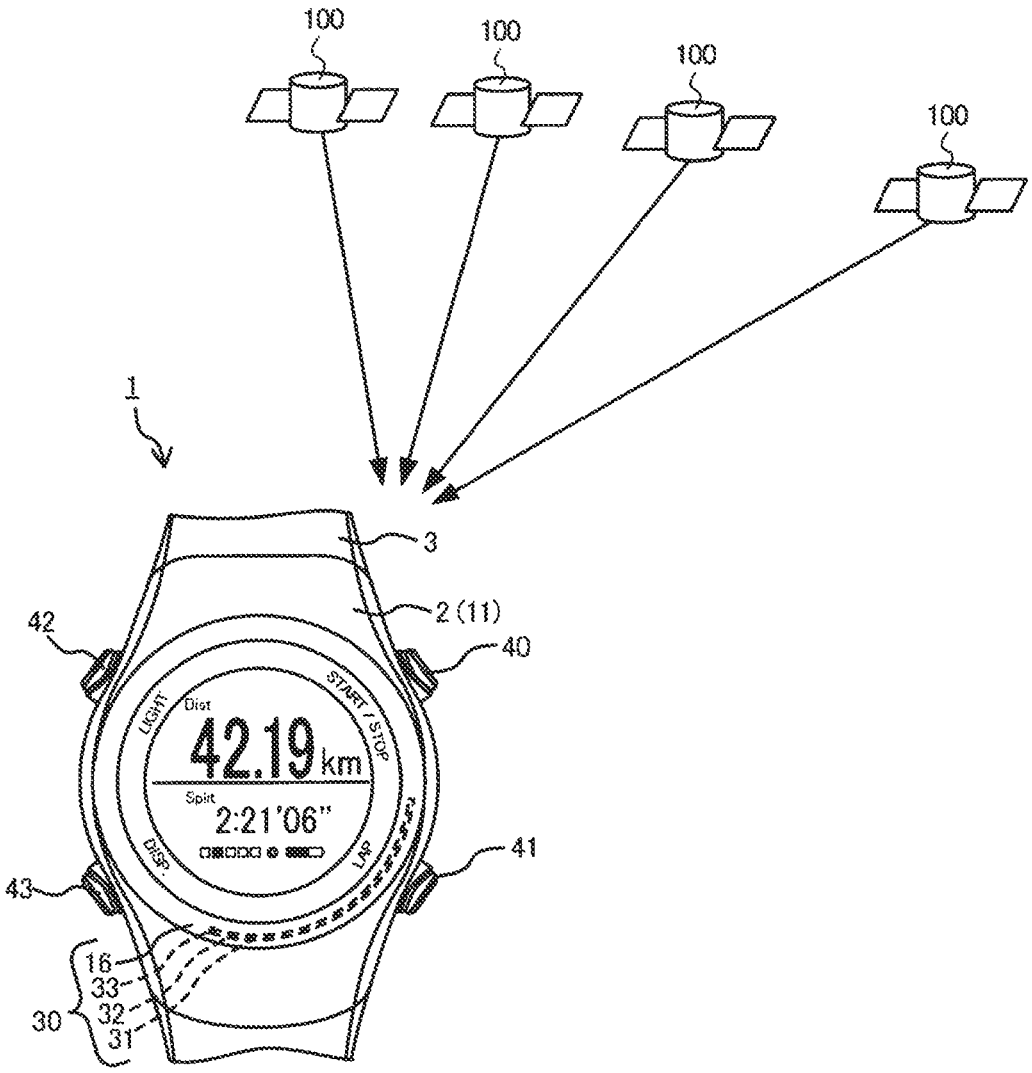
FIG. 1 is an entire diagram of a GPS system including an antenna built-in running watch as an electronic apparatus.

Preferred embodiments of the present disclosure will be described below with reference to the accompanying drawings. In the drawings, the size and scale of each component are appropriately different from actual ones. Further, since the embodiments described below are preferred specific examples of the present disclosure, various technically preferable limitations are imposed, but unless there is a particular limitation in the following description, the scope of the disclosure is not limited to the embodiments.

First Embodiment

A: Mechanical Structure of an Antenna Built-In Electronic Apparatus

As illustrated in FIG. 1, the electronic apparatus 1 of the present embodiment is a running watch of a wristwatch type that the user wears on the wrist, and has a built-in GPS function capable of showing the current position by a GPS receiver receiving a satellite signal transmitted from a plurality of GPS satellites 100 in the sky. The electronic apparatus 1 can automatically measure, for example, the distance, the speed, and the path that the user has run during the running time, from the position information and the time contained in the GPS signal, and assists the exercise of the user.

Figure 2:
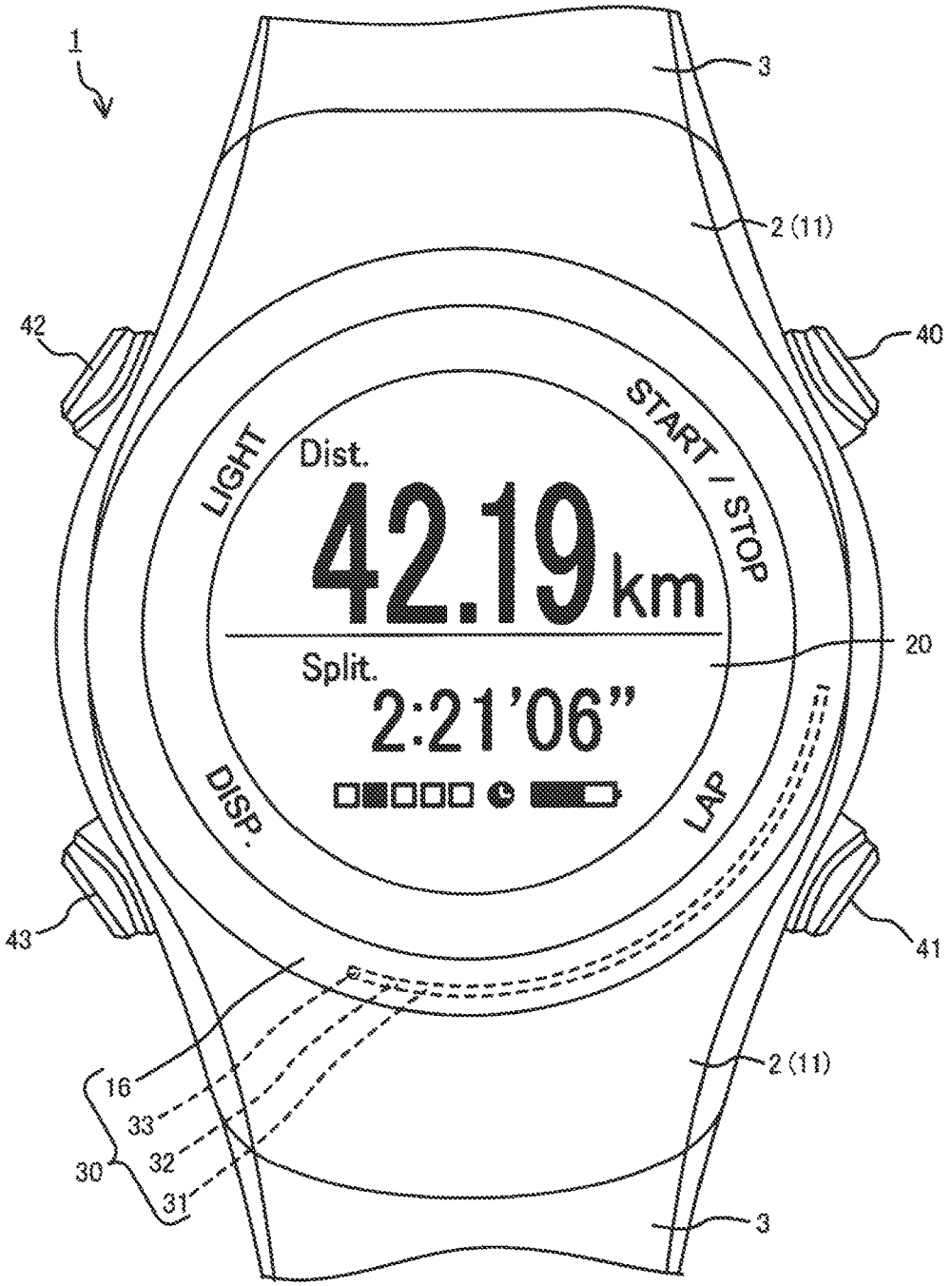
FIG. 2 is a plan view of the electronic apparatus.
Figure 3:
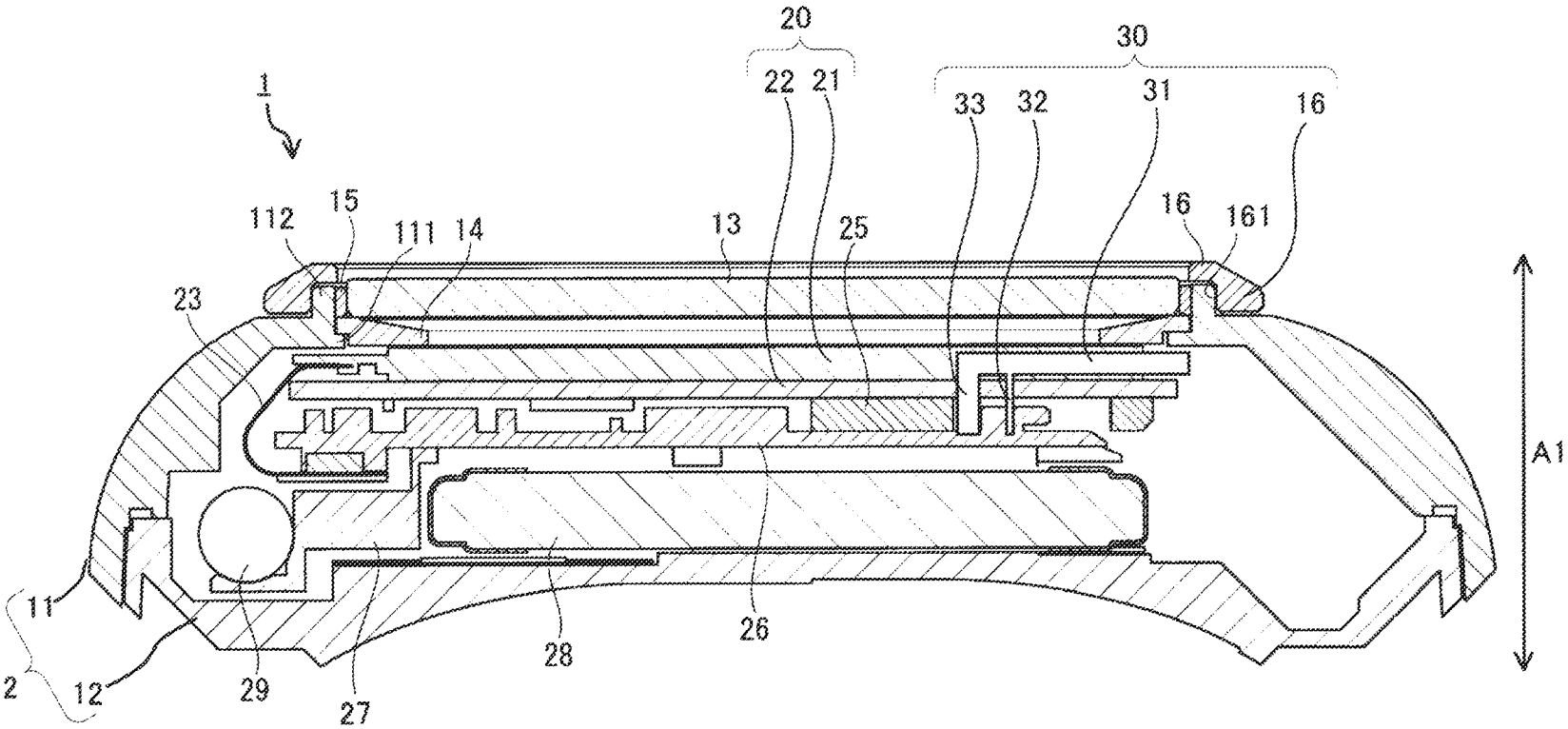
FIG. 3 is a partial sectional view of the electronic apparatus.
Figure 4:
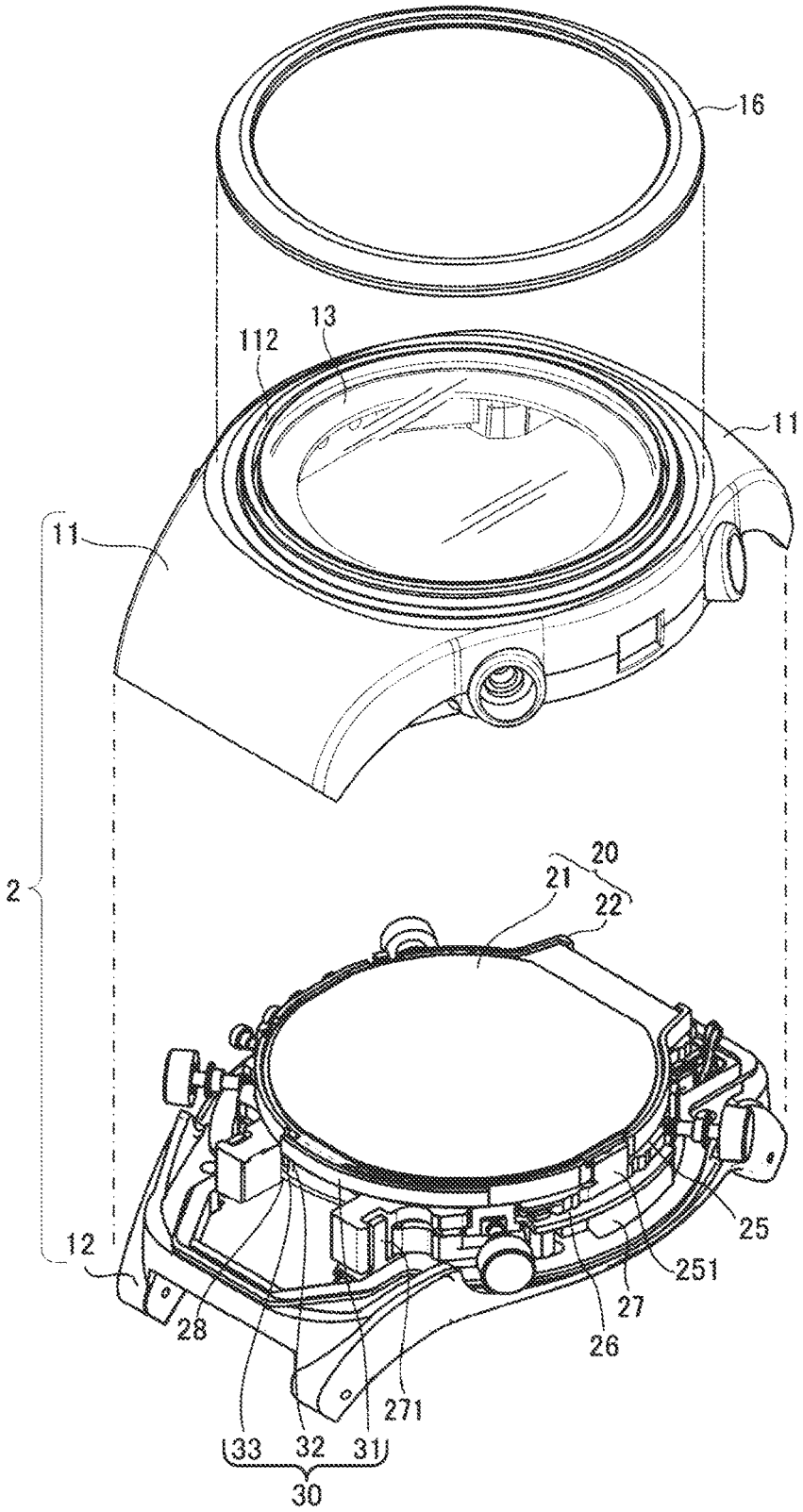
FIG. 4 is a partial exploded perspective view of the electronic apparatus.

The electronic apparatus 1 includes, as illustrated in FIG. 2 to FIG. 4, an outer case 2, and a band 3. In addition, in the electronic apparatus 1, a side from which time and measured data are visible is assumed as a front surface side, and a side that is attached to the arm is assumed as a back surface side. On the front surface of the electronic apparatus 1, when the displayed information is viewed, the upper side is assumed as a 12:00 side and the lower side is assumed as a 6:00 side. This follows the time display in a typical analog wristwatch. Then, a direction (the direction of an arrow A1 illustrated in FIG. 3) connecting the back surface side and the front surface side of the electronic apparatus 1 is assumed as a thickness direction A1 of the electronic apparatus 1.

The outer case 2 includes a case body 11 and a back cover 12. The case body 11 is made of plastic such as polycarbonate resin, and formed in a substantially cylindrical shape. The back cover 12 is attached to the back surface side which is the arm side having the electronic apparatus 1 mounted therein, in the case body 11 and blocks the opening on the back surface side. The back cover 12 may be made of plastic similar to the case body 11, or metal such as stainless steel.

Further, a one-piece type in which the case body 11 and the back cover 12 are integrally formed is employed as the outer case.

Glass (windshield) 13 that is a light transmitting member is attached on the opening on the case body 11, in other words, the front surface side of the outer case 2. In order to support the glass 13, as illustrated in FIG. 3, a protrusion 111 that protrudes inwardly to the opening is formed in the inner peripheral surface on the front surface side of the case body 11. A projection 112 of a circumferential shape having an inner peripheral surface continuous with the inner peripheral surface of the opening, and projecting to the front surface side of the electronic apparatus 1 is formed on the front surface of the case body 11. The supporting ring 14 of the glass 13 is engaged with the surface of the protrusion 111. The glass 13 is disposed on the surface of the supporting ring 14. A ring-like packing 15 is disposed between the glass 13 and the projection 112.

Therefore, after the supporting ring 14 is disposed on the protrusion 111 of the case body 11, the glass 13 is press-fitted into the projection 112 through the packing 15, and thus the glass 13 is attached to the case body 11.

In addition, the light transmitting member is not limited to being made of glass, but may be made of plastic, or a plate-like member through which the user can view the back surface side (display 20 described later) from the front surface side of the light transmitting member.

The bezel 16 is attached to the surface side of the case body 11. The bezel 16 is made of metal such as stainless steel, titanium, aluminum, copper, and silver, and is formed in a ring shape. A plated member can also be used as the bezel 16. A groove 161 that is press-fitted into the outer peripheral surface of the projection 112 is formed on the back surface of the bezel 16.

The diameter of the inner peripheral surface of the groove 161 has substantially the same dimensions as the diameter of the outer peripheral side of the projection 112. Therefore, even when the projection 112 is deformed on the outer peripheral side by press-fitting the glass 13, the bezel 16 made of metal is pressed to and mounted on the projection 112 in advance, and thus it is possible to prevent the deformation of the projection 112. In other words, the bezel 16 has a function to reinforce press-fitting and fixing the glass 13 to the case body 11. Then, it is possible to prevent the projection 112 from being deformed on the outer peripheral side by the bezel 16, such that the packing 15 is disposed between the glass 13 and the projection 112 without a gap so as to secure necessary waterproof properties.

As illustrated in FIG. 4, a display 20, a spacer 25, a circuit board 26, and a circuit case 27 are disposed in the interior space between the case body 11 and the back cover 12 (the interior space of outer case 2), from the glass 13 side (front surface side) towards the back cover 12 side (back surface side).

An antenna 30 is disposed on the side of the display 20 in the interior space of the outer case 2. As illustrated in FIG. 4, the antenna 30 is disposed on one side of the band 3 (on the 6:00 side of the wristwatch), with respect to the display 20 positioned in the surface center of the electronic apparatus 1. The antenna 30 includes a ribbon 31, a power supply 32, an antenna electrode 33, and as described later, the bezel 16 also functions as a portion of the antenna 30. As illustrated in FIG. 3, the power supply 32 and the antenna electrode 33 are connected to the circuit board 26, the power supply 32 is connected to the signal pattern of the circuit board 26, and the antenna electrode 33 is connected to the GND pattern of the circuit board 26. The detailed configuration of the antenna 30 will be described later.

The display 20 includes a liquid crystal panel 21 with a backlight, and a panel frame 22 that holds the liquid crystal panel 21. The liquid crystal panel 21 is connected to the circuit board 26 through the flexible substrate 23. The panel frame 22 is made of a non-conductive member such as plastic.

The spacer 25 is made of a non-conductive member such as plastic, and is disposed between the panel frame 22 and the circuit board 26. A plurality of hooks 251 are formed to protrude on the surface of the spacer 25 (the surface on the glass 13 side), and the hooks 251 hold the panel frame 22 of the display 20.

The circuit board 26 has various ICs and the like mounted therein which control the display of the display 20 or processes a satellite signal received from the antenna 30.

The circuit case 27 is made of a non-conductive member such as plastic, and holds a secondary battery 28, a vibration motor 29, and the like. Further, a plurality of hooks 271 are formed to protrude on the upper surface of the circuit case 27. Then, since the hook 271 is engaged with the spacer 25 while the circuit board 26 is interposed between the spacer 25 and the circuit case 27, the spacer 25, the circuit board 26, and the circuit case 27 are integrated.

B: Circuit Configuration of an Antenna Built-In Electronic Apparatus

Figure 5:
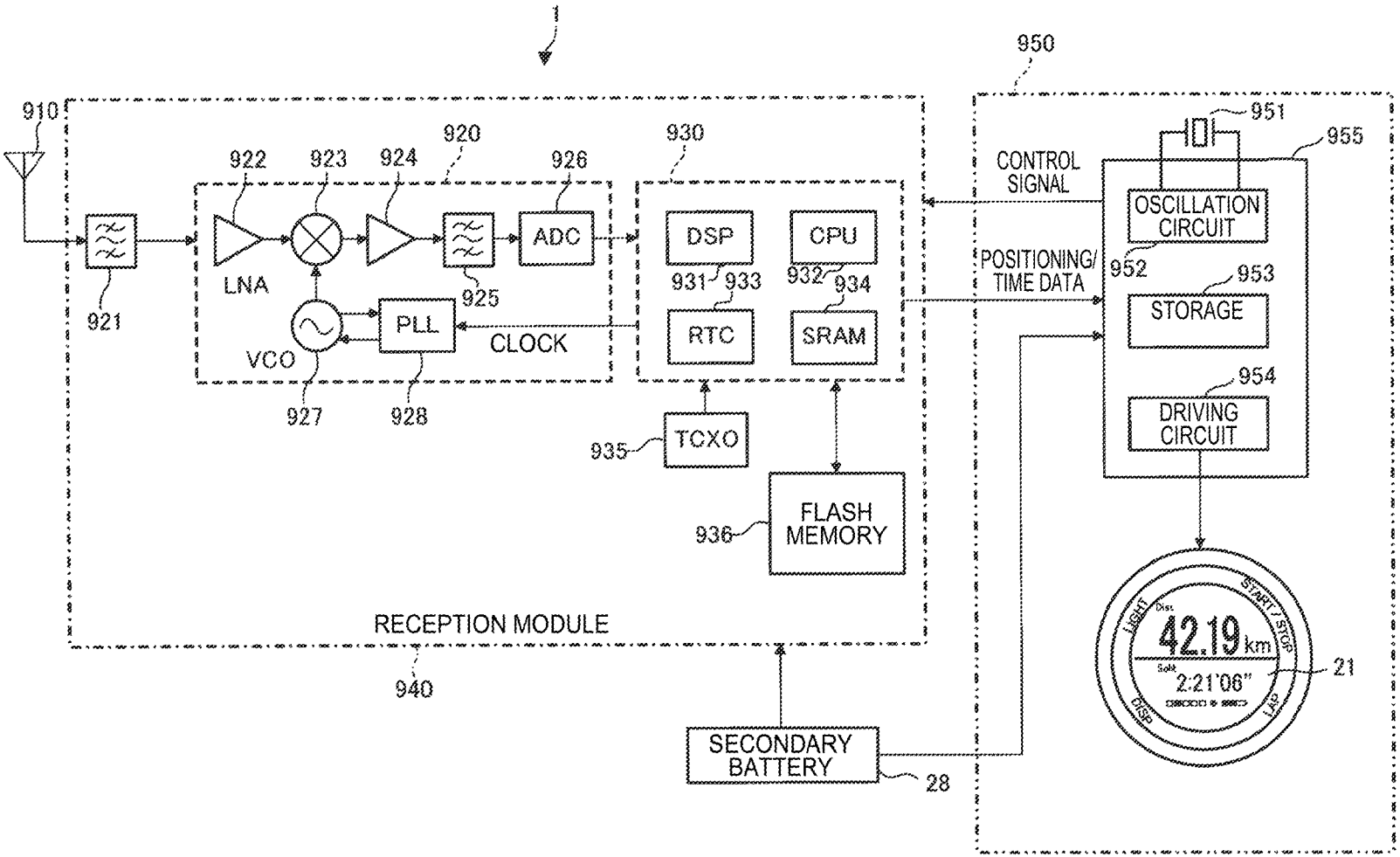
FIG. 5 is a block diagram illustrating a circuit configuration of the electronic apparatus.

Next, the circuit configuration of the electronic apparatus 1 of the present embodiment will be described with reference to FIG. 5. The electronic apparatus 1 of the present embodiment is configured to receive a positioning signal and the like through radio waves from a global positioning system (GPS) satellite and utilize the signal.

A GPS satellite 100 illustrated in FIG. 1 is a position information satellite orbiting on a predetermined trajectory in the sky above the earth, and sends a satellite signal in which a navigation message overlapped with, for example, the microwave of 1.57542 GHz, to the ground. The GPS satellite 100 is equipped with an atomic timepiece, and GPS time information that is extremely accurate time information that is measured by the atomic timepiece is included in the satellite signal. Therefore, the electronic apparatus 1 having a function as a GPS receiver receives the satellite signal and can display accurate time by modifying the lead or lag of the internal time. The modification is performed as a time measuring mode.

Further, the satellite signal includes trajectory information indicating the position on the trajectory of the GPS satellite 100, and the like. In other words, the electronic apparatus 1 can also perform the positioning calculation, and typically, has a function of receiving the satellite signals respectively transmitted from four or more GPS satellites and performing the positioning calculation by using the trajectory information and the GPS time information included in the satellite signals. The electronic apparatus 1 can easily modify the time difference in accordance with the current position by the positioning calculation, and the modification is performed as a positioning mode. The radio waves emitted by the GPS satellite are right-handed circularly polarized waves, and a change in the receiving sensitivity caused by the attitude of the receiving antenna and an error of time measurement and positioning due to the influence of the multipath, such as in the alley of a building are set to be minimized.

In addition, if the satellite signal is used, various applications such as current position display, moving distance measurement, and moving speed measurement are possible, and the electronic apparatus 1 can display these pieces of information on the liquid crystal panel 21 of the display 20. As illustrated in FIG. 1 and FIG. 2, the electronic apparatus 1 includes press buttons 40, 41, 42, and 43, and performs switching and other various controls of information displayed on the liquid crystal panel 21 by operating the press buttons 40, 41, 42, and 43.

Next, the circuit configuration of the electronic apparatus 1 that is an electronic wristwatch having a GPS receiving function will be described. FIG. 5 is a block diagram illustrating the electronic apparatus 1 according to the present embodiment. As illustrated in FIG. 5, the electronic apparatus 1 is configured to include an antenna 910, a reception module (receiver) 940, a display 950 including a controller (processor) 955, and a secondary battery 28.

The reception module 940 is connected to the antenna 910, and is configured to include a surface acoustic wave (SAW) filter 921, a radio frequency (RF) unit 920, and a baseband unit 930. The SAW filter 921 performs a process of extracting a satellite signal from radio waves received by the antenna 910. The RF unit 920 is configured to include a low noise amplifier (LNA) 922, a mixer 923, a voltage controlled oscillator (VCO) 927, a phase locked loop (PLL) control circuit 928, an intermediate frequency (IF) amplifier 924, an IF filter 925, and an A/D converter (ADC) 926.

The satellite signal extracted by the SAW filter 921 is amplified by the LNA 922, mixed with a local signal that is output by the VCO 927 in the mixer 923, and down-converted into a signal of an intermediate frequency band. The PLL control circuit 928 and the VCO 927 form a phase-locked loop and a signal obtained by frequencydividing the local signal that is output by the VCO 927 and a stable reference clock signal are subjected to a phase comparison, and the local signal and the reference clock signal are synchronized by feedback, and a local signal of a correct frequency is intended to be generated and stabilized. A signal mixed in the mixer 923 is amplified by the IF amplifier 924, and an unnecessary signal is removed by the IF filter 925. The signal passing through the IF filter 925 is converted into a digital signal by the A/D converter (ADC) 926.

The baseband unit 930 is configured to include a digital signal processor (DSP) 931, a central processing unit (CPU) 932, a static random access memory (SRAM) 934, and a real time clock (RTC) 933. Further, a temperature compensated crystal oscillator (TCXO) 935, a flash memory 936, and the like are connected to the baseband unit 930.

The temperature compensated crystal oscillator (TCXO) 935 generates a reference clock signal of a substantially constant frequency irrespective of temperature, and current position information, time difference information and the like are stored in the flash memory 936. In a time measuring mode and the like, the baseband unit 930 performs a process of demodulating a baseband signal from a digital signal that has been obtained through the conversion by the ADC 926 of the RF unit 920. Further, the baseband unit 930 acquires the satellite information such as trajectory information and GPS time information which are included in a navigation message captured from the GPS satellite 100, and stores the satellite information in the SRAM 934.

The display 950 is configured to include the controller 955, a quartz oscillator 951, and the like. The controller 955 includes a storage 953, an oscillation circuit 952, and a driving circuit 954, and performs various controls. The controller 955 controls the reception module 940, transmits a control signal to the reception module 940, controls the reception operation of the reception module 940, and controls the display of the liquid crystal panel 21 through the driving circuit 954 in the controller 955. Various pieces of information including the internal time information are stored in the storage 953. The secondary battery 28 supplies the energy required for the operation and display of the circuit.

The controller 955, the CPU 932, and the DSP 931 calculate the time measuring and the positioning information in cooperation with each other, and determine information such as time, a current position, a moving distance, and a movement speed, based on the information. Further, the controller 955 performs the control of display of the information on the liquid crystal panel 21 and control such as setting of an operation mode or a display mode of the electronic apparatus 1 in response to the operation of the press buttons 40, 41, 42 and 43 illustrated in FIG. 1 and FIG. 2. It is possible to have advanced functions such as navigation of displaying the current position on the map.

C: Detailed Configuration of Antenna

Next, the configuration of the antenna 30 of the electronic apparatus 1 of the present embodiment will be described in detail with reference to the accompanying drawings.

Figure 6:
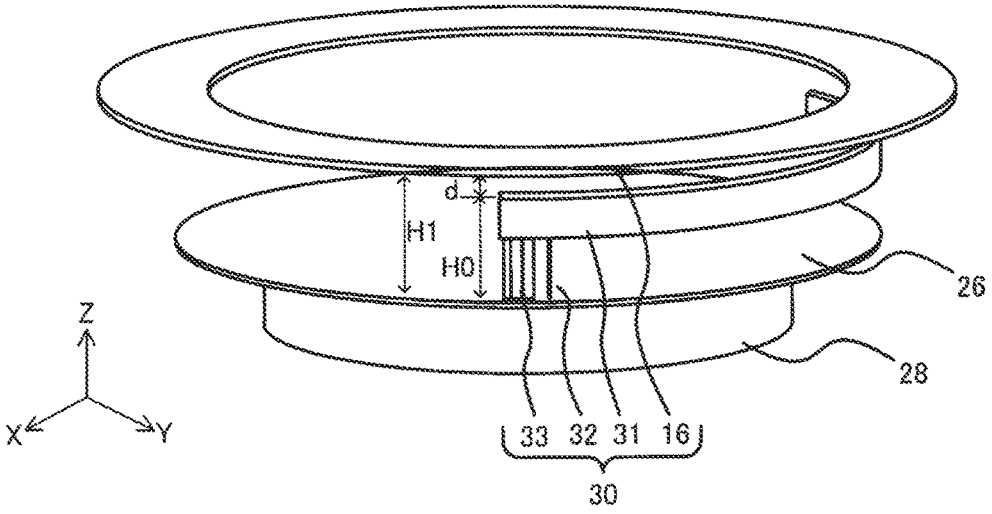
FIG. 6 is a schematic diagram explaining a configuration of an antenna of the electronic apparatus.

FIG. 6 is a schematic diagram explaining the configuration of the antenna 30 in the present embodiment. As illustrated in FIG. 6, the antenna 30 of the present embodiment includes an arcuate ribbon 31 which is a second element, a linear power supply 32, a linear antenna electrode 33, and a ring-shaped bezel 16 which is a first element.

The ribbon 31, the power supply 32, and the antenna electrode 33 can be easily configured using a copper wire or an aluminum wire, or a pipe. A copper wire or a thin aluminum plate may be used. The electrode may be formed by sticking, etching, or printing a conductive foil on a base of a suitable shape. The electrode may be formed by applying plating in the inner wall of the case body 11.

The bezel 16 is made of a metal such as stainless steel, titanium, aluminum, copper, and silver, and formed in a notch-free ring (O-shaped). A bezel formed by plating a resin or the like may be used as the bezel 16, in addition to the metal-made bezel.

The power supply 32 and the antenna electrode 33 are connected to one end of the ribbon 31, and the other end of the ribbon 31 is open. The power supply 32 and the antenna electrode 33 are connected to the circuit board 26, the power supply 32 is connected to the signal pattern of the circuit board 26, and the antenna electrode 33 is connected to the GND pattern of the circuit board 26.

As illustrated in FIG. 4, the ribbon 31 is disposed on the 6:00 side of the wristwatch which is the position of the side of the display 20, in the interior space of the outer case 2. For example, a groove, not shown, is formed in the inside of the case body 11 constituting the outer case 2 and the ribbon 31 is received and held in the groove. In addition, a method of holding the ribbon 31 may use for example, a method of providing convex portions for guiding the ribbon 31 at a plurality of positions in the inside of the case body 11 and holding the ribbon 31 by the convex portions, as well as the method of using the groove.

Figure 7:
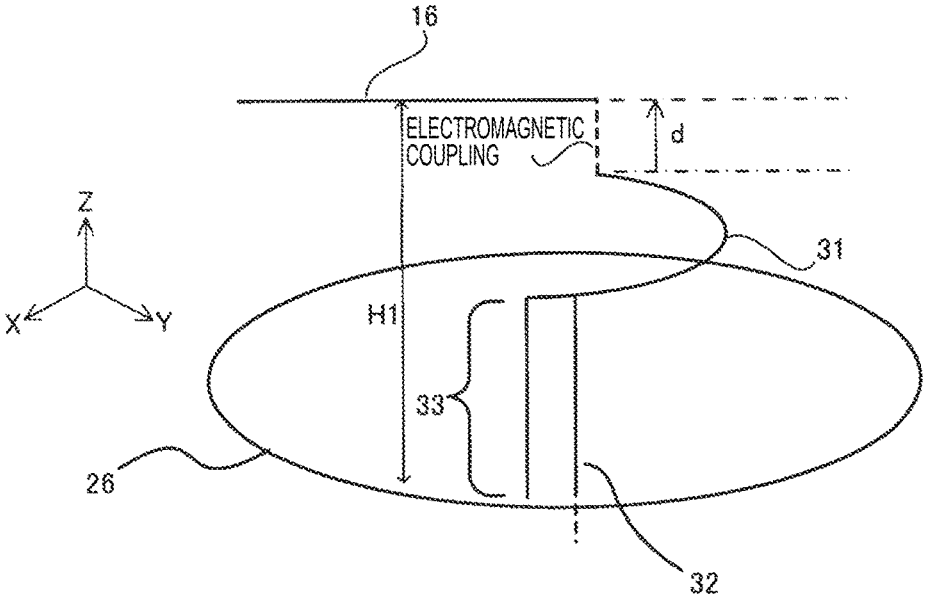
FIG. 7 is a schematic diagram explaining a principle of the antenna of the electronic apparatus.

FIG. 7 is a schematic diagram explaining a principle of the antenna 30 in the present embodiment. The ribbon 31 and the antenna electrode 33 of the antenna 30 in the present embodiment have the same configuration as in the case where the ribbon 31 which is an arcuate loop element (magnetic current element) and an antenna electrode 33 which is a linear element (current element) are formed, by bending a dipole antenna having a length sufficiently shorter than 1λ.

As illustrated in FIG. 2, the ribbon 31 is disposed at a position overlapping the bezel 16 in a plan view, is disposed below the bezel 16 in a vertical direction (a direction perpendicular to a plane direction of FIG. 2, a display direction of display 20), and has a predetermined distance from the bezel 16. Such a configuration enables the bezel 16 to be electromagnetically coupled to the ribbon 31. In the present embodiment, as described below, the electromagnetically coupled bezel 16 is used as an extension of the linear element (current element).

The power supply 32 for moving the feed point is connected to the ribbon 31. The antenna electrode 33 is connected to the GND pattern of the circuit board 26, and the power supply 32 is connected to the signal pattern of the circuit board 26. In such a configuration, the antenna electrode 33 and the bezel 16 operate as a current element that outputs a current vector, and the ribbon 31 operates as a magnetic current element that outputs a magnetic current vector. In other words, the circuit board 26 functions as a GND plate, and the circuit board 26 is disposed below the ribbon 31 in the vertical direction.

If considering the antenna electrode 33 as a current element disposed in the Z-axis direction at the coordinate origin, the radiated electromagnetic field by the antenna electrode 33 shows non-directivity in the XY plane (donut-like directivity), as is well known.

If considering the ribbon 31 as a magnetic element disposed in the Z-axis direction at the coordinate origin, the radiated electromagnetic field by the ribbon 31 shows non-directivity in the XY plane (donut-like directivity), as is well known.

If the direction of the electric field generated by the antenna electrode 33 and the direction of the electric field generated by the ribbon 31 are orthogonal and the phases of the current flowing through the antenna electrode 33 and the current flowing through the ribbon 31 are the same, the phases of the electric fields generated from both are different by 90°, and their synthesized wave is circularly polarized.

In the present embodiment, since the electronic apparatus 1 which is a wristwatch satisfies the visibility of a display and the portability of a clock, it is preferable to form the outer shape of the outer case to have a diameter of substantially 20 mm or more to 50 mm or less in a plan view of the wristwatch. The bezel 16 does not have a notch formed therein unlike the ribbon 31, and is a closed O-shape ring. In the present embodiment, as an example, the bezel 16 of a diameter of 30 mm is used. Therefore, the circumference of the bezel 16 is approximately 90 mm.

However, since the bezel 16 is an O-shaped ring without a notch, the current flowing through the bezel 16 is symmetric, and does not function as a loop element. In other words, even if one point of the bezel 16 is power-supplied, the current flows in both directions from the feeding point. Therefore, the bezel 16 is equivalently considered as one linear element, and the equivalent electrical length is close to the diameter, rather than the circumference of the bezel 16.

The electronic apparatus 1 of the present embodiment receives GPS radio waves at approximately 1.5 GHz of which one wavelength (1λ) is approximately 20 cm. Therefore, the equivalent electrical length of the bezel 16 is sufficiently shorter than 1λ.

In the antenna 30 of the present embodiment, the equivalent electrical length obtained by adding the equivalent electrical length of the bezel 16, the equivalent electrical length of the ribbon 31, and the equivalent electrical length of the antenna electrode 33 is set to be ¼λ. Since the antenna electrode 33 is connected to the GND pattern of the circuit board 26 which is the GND plate, an image antenna of ¼λ is formed on the circuit board 26 in the antenna 30 of the present embodiment, as a ground plane antenna. Therefore, the antenna 30 of the present embodiment operates as an antenna having an equivalent electrical length of ½λ. Thus, the antenna 30 of the present embodiment ideally has directivity in the same vertical plane as in the vertical dipole antenna of ½λ. Further, the loop portion of the ribbon has directivity of the micro-loop unlike the loop antenna of 1×λ. The directivity of the micro-loop is the directivity obtained by rotating the directivity of a loop of 1λ by 90 degrees in a direction perpendicular to the loop diameter, which is consistent with the directivity of the ground plane antenna. The electric field generated by the ground plane antenna and the electric field generated by the micro-loop are different by 180° in their phases. This can generate circularly polarized waves.

The GPS radio waves of approximately 1.5 GHz have 1λ of approximately 20 cm, and ¼λ which is the equivalent electrical length of the antenna 30 is approximately 5 cm. However, λ is a free space wavelength, and in practice, is set to within a predetermined range due to the influence of surrounding members. For example, in the present embodiment, λ is set to a range of 0.8×(¼λ) to 1.3×(¼λ), in other words, a range of 4 cm to 6.5 cm, as an example.

The ribbon 31 which is the second element uses radio waves of a thickness of 100 μm, a width of 2 mm, and a length of 3.5 cm, as an example. When ¼λ is approximately 5 cm, the length is a length of ¼λ×0.7.

The equivalent electrical length of the bezel 16 which is the first element is 4.5 cm that is a length of approximately half the circumference of the bezel 16. However, the bezel 16 is disposed at a position overlapping the ribbon 31 in a plan view of the wristwatch. By this arrangement, since a portion of the bezel 16 overlapping the ribbon 31 in a plan view of the wristwatch does not function as an equivalent electrical length of the antenna 30, the equivalent electrical length of the bezel 16 which is the first element is 1.5 cm.

Then, the length of the antenna electrode 33 is a distance from the lower end surface of the ribbon to a GND pattern, and is 1 mm as an example.

Therefore, in the present embodiment, the length satisfying the equivalent electrical length of the bezel 16 and the length of the ribbon 31 is set to be ¼λ in 50 mm. If adding the length to the length of the antenna electrode 33, the length is 51 mm, and is set to be approximately ¼λ as a whole.

In addition, these lengths can be determined by simulation such as a moment method.

Next, the electromagnetic coupling between the bezel 16 which is the first element and the ribbon 31 which is the second element will be described in detail.

As illustrated in FIG. 2, in a plan view, the ribbon 31 is disposed at a position overlapping the bezel 16, and is configured such that the electromagnetic coupling becomes stronger. In a vertical direction (a direction perpendicular to a plane direction of FIG. 2), as illustrated in FIG. 6, the ribbon 31 is disposed at a predetermined distance from the bezel 16. Since the electromagnetic coupling becomes stronger, it is preferable that a distance d between the ribbon 31 and the bezel 16 is set in a range of 0.5 mm to 2.0 mm. In the present embodiment, the distance d is set to be 2 mm.

As described above, if the bezel 16 is equivalently considered as one linear element and is electromagnetically coupled with the ribbon 31, the bezel 16 has a function to increase a current flowing through the ribbon 31, as in a horizontal portion of a reversed L antenna.

In addition, as illustrated in FIG. 6, if a distance from the circuit board 26 to the ribbon 31 is H0 and a distance between the ribbon 31 and the bezel 16 is d, the bezel 16 has a function to increase a distance H1 from the circuit board 26 to the bezel 16 functioning as a receiving surface by the distance d between the ribbon 31 and the bezel 16.

$$H1=H0+d$$

It is possible to increase the radiation efficiency of the antenna 30, by increasing the distance H1 from the circuit board 26 to the bezel 16 functioning as a receiving surface.

Figure 8:
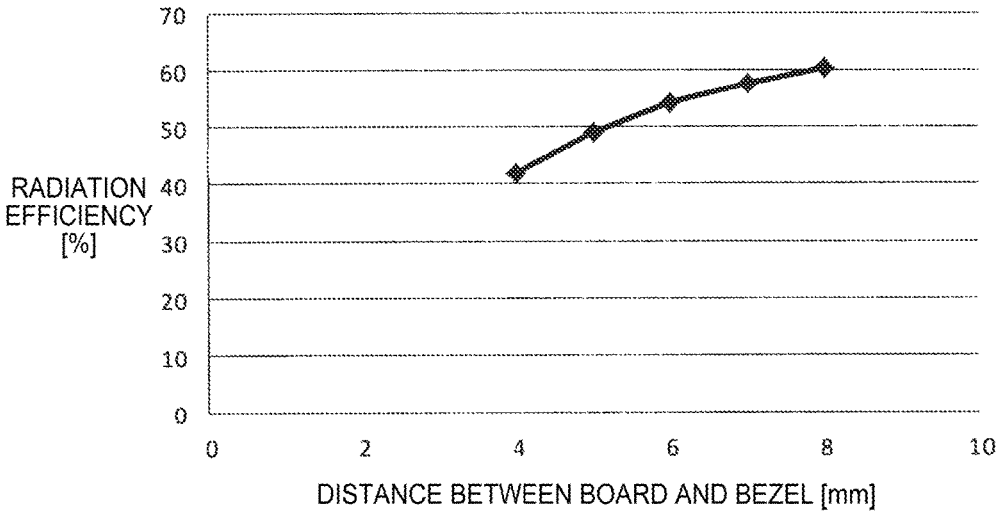
FIG. 8 is a graph illustrating a simulation result of radiation efficiency of the antenna of the electronic apparatus.

FIG. 8 illustrates an example by electromagnetic field simulation obtained by calculating a change in the radiation efficiency of the antenna 30 depending on the distance H1 from the circuit board 26 to the bezel 16. In this simulation, the diameter of the bezel 16 is 30 mm, a distance (H1 in FIG. 6) from the GND pattern to the bezel 16 is set to 4.5 mm, and a distance d between the ribbon 31 and the bezel 16 is fixed to 2 mm. As can be seen from FIG. 8, the longer the distance H1 from the circuit board 26 to the bezel 16 is, the higher the radiation efficiency is.

Further, if comparing the radiation efficiencies of the case where there is the bezel 16 and the case where there is no bezel 16, under the same conditions, it is confirmed that the radiation efficiency rises up to 42% in the case where there is the bezel 16, while the radiation efficiency is 31% in the case where there is no bezel 16. In addition, the radiation efficiency changes with a degree of coupling of these two members according to the distance H1 between the bezel 16 and the ribbon 31.

As described above, a longer a distance H1 from the feeding point that is a connection point between the power supply 32 and the circuit board 26 to the lower surface of the bezel 16 is, the stronger the strength of the electric field generated in the ribbon 31 which is a loop element, but in the present embodiment, the distance H1 is set such that the strength of the electric field generated in the antenna electrode 33 and the strength of the electric field generated in the ribbon 31 which is a loop element are equal to each other. When these electric field strengths are equal, it is possible to generate complete circularly polarized waves.

In addition, since the bezel 16 is the closed O-shaped ring, current having reversed direction exist in the bezel 16, the radio waves emitted from the bezel 16 are weakened by being cancelled, and do not affect the radio waves of circularly polarized waves emitted from the ribbon 31 and the antenna electrode 33.

Further, for the antenna 30 of the present embodiment, the power feeding position is adjusted as a reversed F antenna by the power supply 32, the adjustment of power feeding to the antenna 30 is easy, and a large current can flow to the antenna electrode 33.

As described above, in the antenna 30 of the present embodiment, the equivalent electrical length obtained by adding the equivalent electrical length of the bezel 16, the equivalent electrical length of the ribbon 31, and the equivalent electrical length of the antenna electrode 33 is set to be ¼λ, and the antenna 30 is connected to the GND pattern of the circuit board 26 by the antenna electrode 33. Therefore, an image antenna of a ¼λ is formed in the circuit board 26, and the antenna 30 of the present embodiment has the same directivity as in the same vertical plane in the vertical dipole antenna of ½λ.

Figure 9:
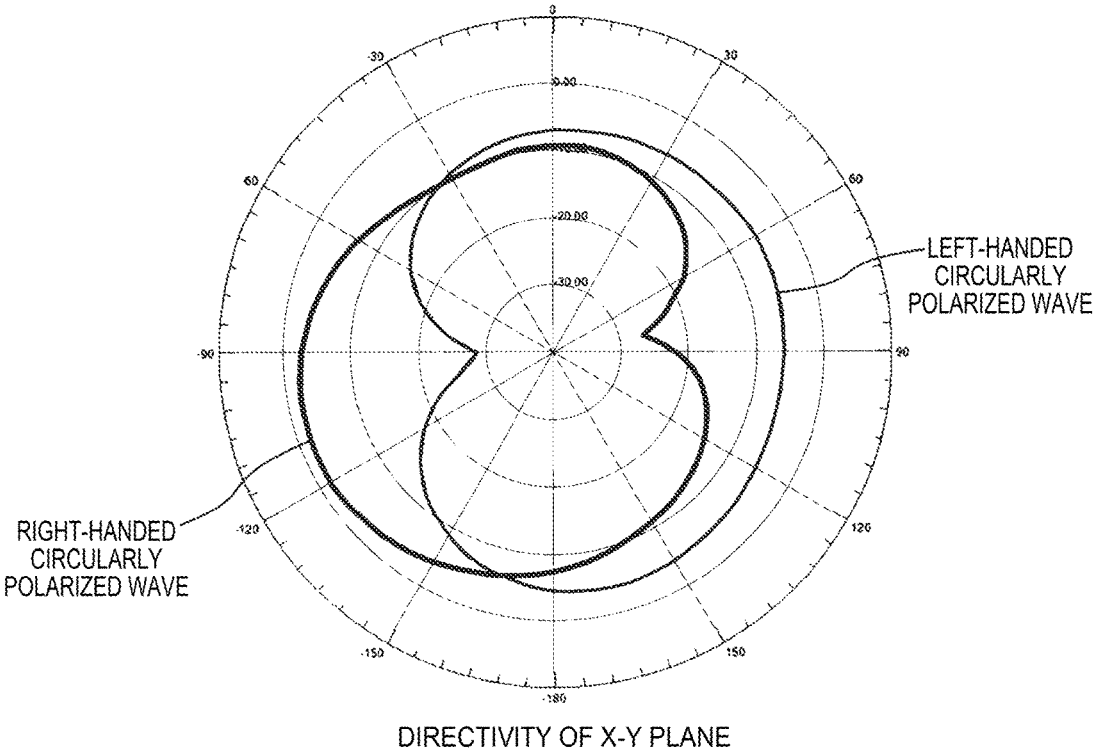
FIG. 9 is a diagram illustrating the directivity in an XY plane of the antenna of the electronic apparatus.
Figure 10:
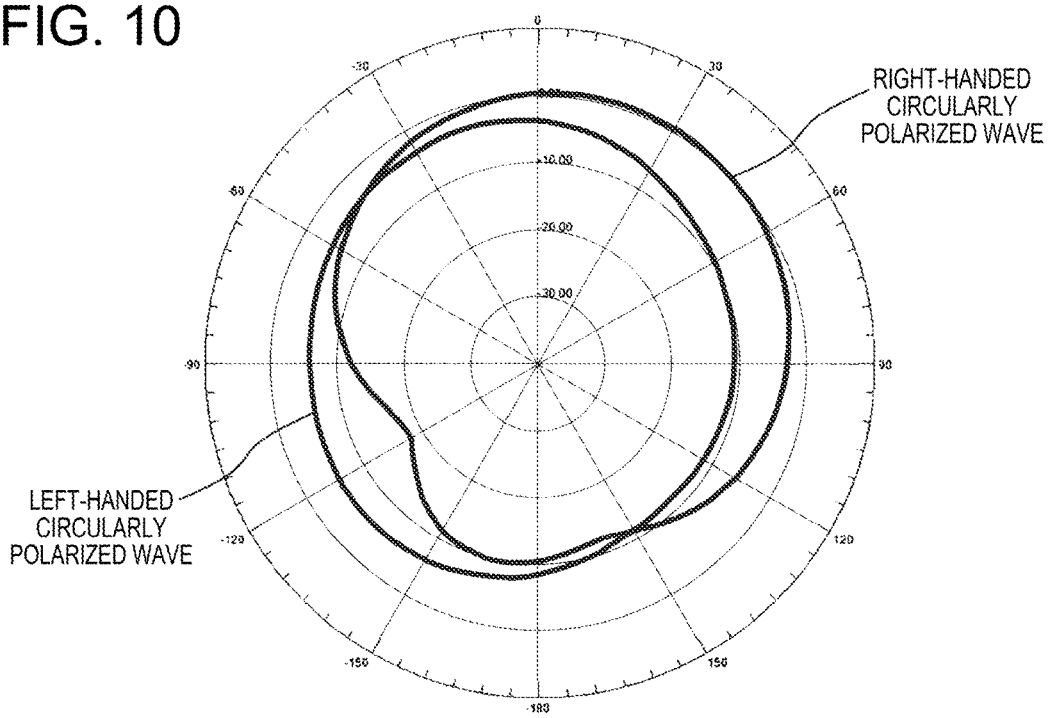
FIG. 10 is a diagram illustrating the directivity in an XZ plane of the antenna of the electronic apparatus.
Figure 11:
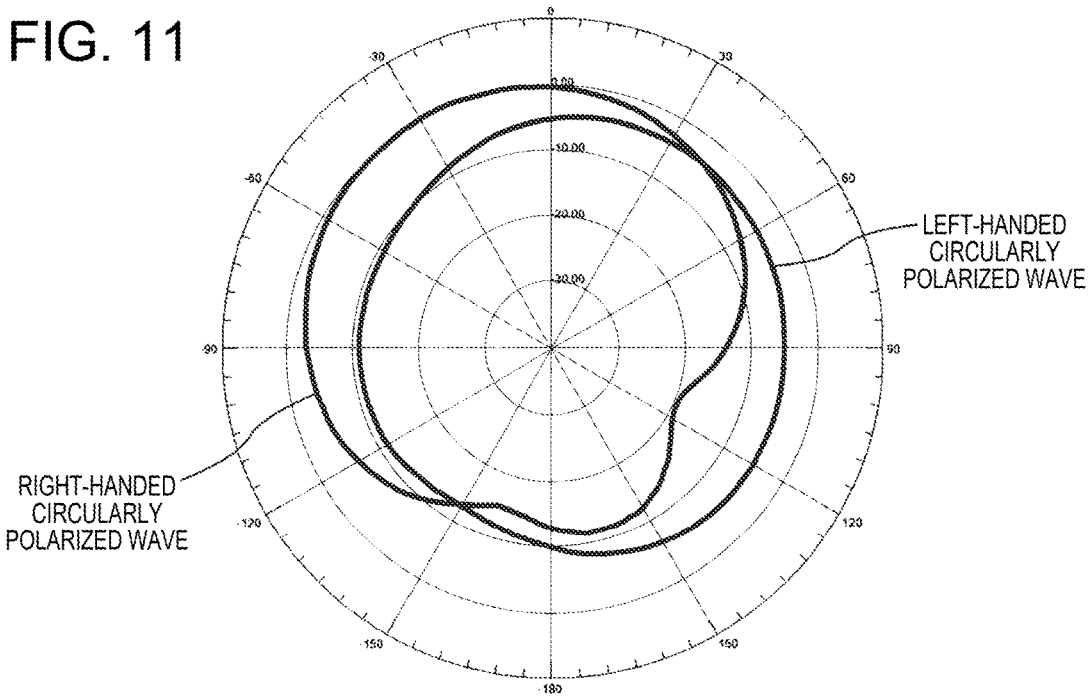
FIG. 11 is a diagram illustrating the directivity in a YZ plane of the antenna of the electronic apparatus.

As illustrated in FIG. 6, if a direction perpendicular to the circuit board 26 is set to a Z-axis direction, and a direction parallel to the circuit board 26 is set to a X-axis direction and a Y-axis direction, the directivities of the radio waves of the circularly polarized waves emitted by the antenna 30 of the present embodiment are illustrated in FIG. 9 to FIG. 11. As illustrated in FIG. 9, it can be seen that with respect to the directivity of an X-Y plane, right-handed circularly polarized waves and left-handed circularly polarized waves do not overlap, and the radio waves emitted by the antenna 30 are circularly polarized waves. Further, it can be seen that the right-handed circularly polarized waves are superior to the left-handed circularly polarized waves, and the radio waves emitted by the antenna 30 are right-handed circularly polarized waves.

It is confirmed that from the directivity of an X-Z plane illustrated in FIG. 10 and the directivity of an Y-Z plane illustrated in FIG. 11, the axial ratio that is a difference between the right-handed circularly polarized waves and the left-handed circularly polarized waves is about 10 dB, and it can be seen that the radio waves emitted by the antenna 30 of the present embodiment are good right-handed circularly polarized waves.

Further, when the electronic apparatus 1 is attached to the user's arm, the direction toward the arm is −Z axis direction and the direction toward the outside is +Z axis direction, but as can be seen from FIG. 10 and FIG. 11, the right-handed circularly polarized waves are superior in the +Z axis direction. Therefore, the antenna 30 of the present embodiment can be mainly used as the antenna of the right-handed circularly polarized waves.

As described above, according to the present embodiment, the glass 13 is press-fitted and fixed to the case body 11, and the bezel 16 functions as a part of the antenna 30, which is used to dispose the packing 15 between the glass 13 and the projection 112 are disposed without a gap, such that it is possible to increase the distance H1 from the circuit board 26 to the receiving surface than in the related art, and to improve the radiation efficiency of the antenna 30.

According to the present embodiment, as illustrated in FIG. 9 to FIG. 11, the circularly polarized waves are obtained, such that it is possible to provide an electronic apparatus capable of receiving radio waves from any direction, when performing mobile communication using satellite and reception of GPS radio waves. In addition, in the antenna 30 of the present embodiment, the ribbon 31 which is the loop element is rotated to the left when viewed from the power supply 32, and as a result, the right-handed circularly polarized waves are mainly obtained. When the ribbon 31 is rotated to the right when viewed from the power supply 32, and as a result, the left-handed circularly polarized waves are mainly obtained, such that it is preferable to change the direction as appropriate according to the intended use or the like of the electronic apparatus 1.

According to the present embodiment, since the bezel 16 made of metal that has been provided for design improvement of the wristwatch-type electronic apparatus 1 and strength improvement of the case thereof is regarded and used as a part of the antenna 30, only the ribbon 31 which is the loop element, the antenna electrode 33, and the power supply 32 are required for the antenna dedicated member, it is possible to reduce the volume of the antenna member to minimum. Further, even if it is difficult to ensure the height from the circuit board 26 to the receiving surface from a demand or the like on the design, it is possible to ensure the height from the circuit board 26 to the receiving surface by regarding and using the bezel 16 as a part of the antenna 30.

Further, according to the present embodiment, since the number of components of the antenna is reduced as described above, it is possible to suppress the component cost to approximately one of tenth as compared to the patch antenna.

If an antenna has basically a large volume, the radiation efficiency is improved. In the antenna 30 of the present embodiment, the bezel made of metal operates as the antenna electrode for the GND pattern of the circuit board 26, and the entire case equivalently operates as an antenna. Therefore, the antenna is equivalent to an antenna of a large volume, and it is possible to obtain good radiation efficiency.

In addition, in present embodiment, as illustrated in FIG. 2, although the center position of the ribbon 31 is disposed so as to be near the 5:00 position, the disclosure is not limited to such a configuration. For example, the center position of the ribbon 31 may be arranged so as to be near the 6:00 position.

Second Embodiment

Next, the second embodiment of the present disclosure will be described with reference to FIG. 12. In the first embodiment, the disclosure is applied to a digital-type running watch as an example of an electronic apparatus. In the present embodiment, the disclosure is applied to an analog-type GPS watch as an example of an electronic apparatus. In addition, the same configurations in the first embodiment are denoted by the same reference numerals, and duplicate explanation may be omitted.

Figure 12:
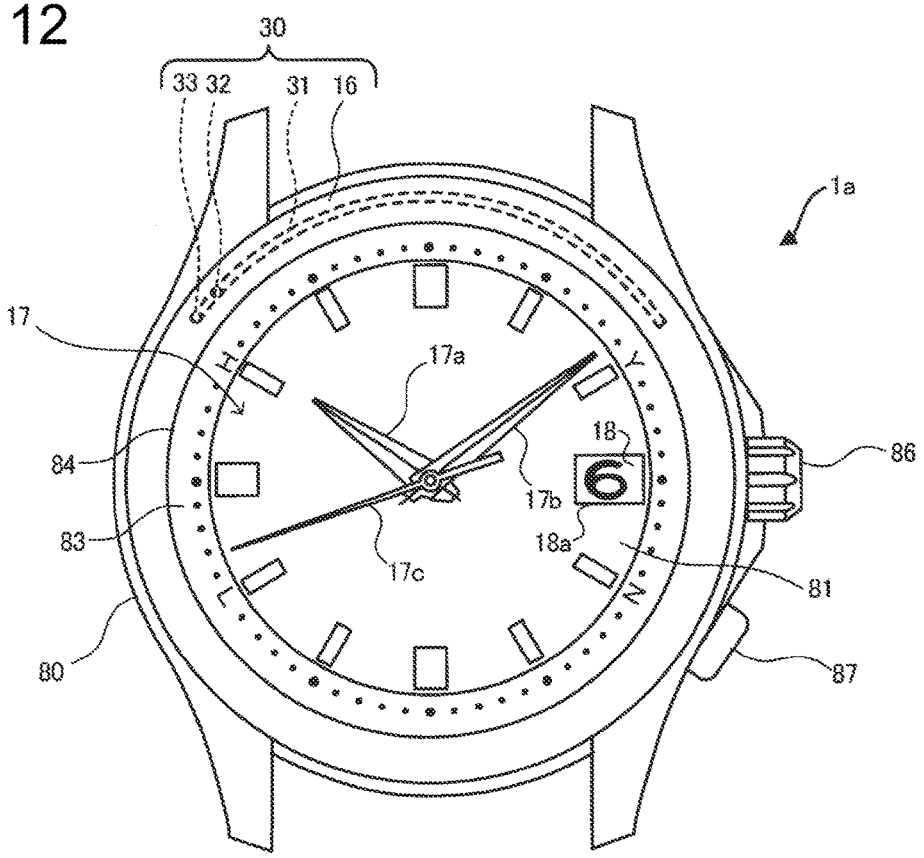
FIG. 12 is a plan view of an analog GPS watch as the electronic apparatus.

An electronic apparatus 1*a* of the present embodiment illustrated in FIG. 12 is driven by power generated by solar panels, and is a solar-driven radio-controlled timepiece which performs the time correction by receiving a GPS signal. The electronic apparatus 1*a* is provided with an outer case 80. The outer case 80 is a cylindrical case made of a metal. In the outer case 80, the bezel 16 made of metal is formed by being fitted.

A disc-shaped character plate 81 is disposed as a time display portion, on the inner circumferential side of the bezel 16, through a ring-shaped dial ring 83 made of plastic. The pointer 17 that displays the time and date and the like are disposed on this character plate 81. The pointer 17 is configured with an hour hand 17*a*, a minute hand 17*b*, and a second hand 17*c*. A date viewing window 18*a* is opened and formed on the character plate 81, and the date displayed in a date wheel 18 has become visible from the date viewing window 18*a*.

The opening on the surface side of the outer case 80 is closed by the cover glass 84 through the bezel 16, and the character plate 81, the pointer 17 (the hour hand 17*a*, the minute hand 17*b*, and the second hand 17*c*) in the inside become visible through the cover glass 84.

The electronic apparatus 1*a* is configured to be able to perform a manual time correction by manually operating the crown 86, and to perform switching between a normal time display mode and a time difference correction mode, by manually operating the operation buttons 87. In addition, the electronic apparatus 1*a* of the present embodiment has a time correction function for correcting the time by receiving automatically and daily a GPS signal. It is also possible to forcibly receive the GPS signal by manually operating the operation buttons 87.

Even in the present embodiment, the antenna 30 includes an arcuate ribbon 31, a linear power supply 32, a linear antenna electrode 33, and a ring-shaped bezel 16.

The ribbon 31, the power supply 32, and the antenna electrode 33 can be easily configured using a wire such as a copper wire or a pipe. The electrode may be formed by sticking, etching, or printing a conductive foil on a base of a suitable shape. The bezel 16 can be made of a metal such as stainless steel and titanium.

The power supply 32 and the antenna electrode 33 are connected to one end of the ribbon 31, and the other end of the ribbon 31 is open. The power supply 32 and the antenna electrode 33 are connected to the circuit board 26, the power supply 32 is connected to the signal pattern of the circuit board 26, and the antenna electrode 33 is connected to the GND pattern of the circuit board 26.

In the ribbon 31 of the present embodiment, the direction extending from the power supply 32, unlike the first embodiment, is counterclockwise in a plan view. In this way, even if the extending direction of the ribbon 31 is a counterclockwise, it is possible to mainly obtain the right-handed circularly polarized waves due to the influence of the component in the vicinity, similar to the first embodiment.

As described above, the antenna 30 of the present disclosure can also be applied to the pointer-type GPS watch. Further, it is possible to make the extension direction of the ribbon 31 as a counterclockwise direction.

MODIFICATION EXAMPLES

The present disclosure is not limited to the embodiments described above, and for example, various kinds of deformation are possible as described below. Furthermore, the aspects of the deformation described below may be those in which one or more arbitrarily selected configuration may be combined appropriately. In addition, the same configurations in the first and second embodiments are denoted by the same reference numerals, and duplicate explanation may be omitted.

Modification Example 1

In each of the above described embodiments, an example in which the O-shaped ring is employed as the bezel 16 which is the second element has been described. However, the present disclosure is not necessarily to be limited to such an example, and the bezel 16 may be, for example, a rectangular shape.

Figure 13:
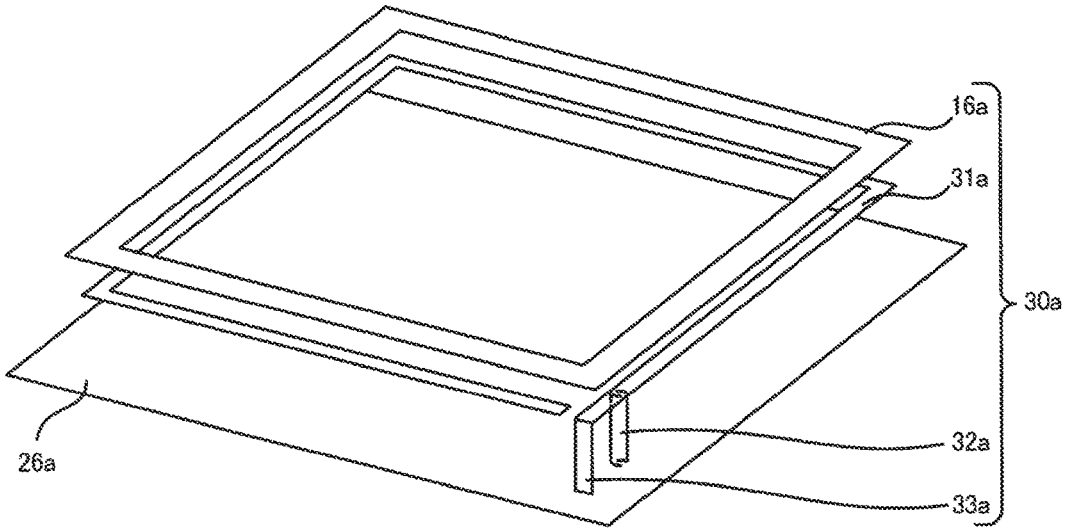
FIG. 13 is a schematic diagram explaining another configuration of the antenna.
Figure 14:
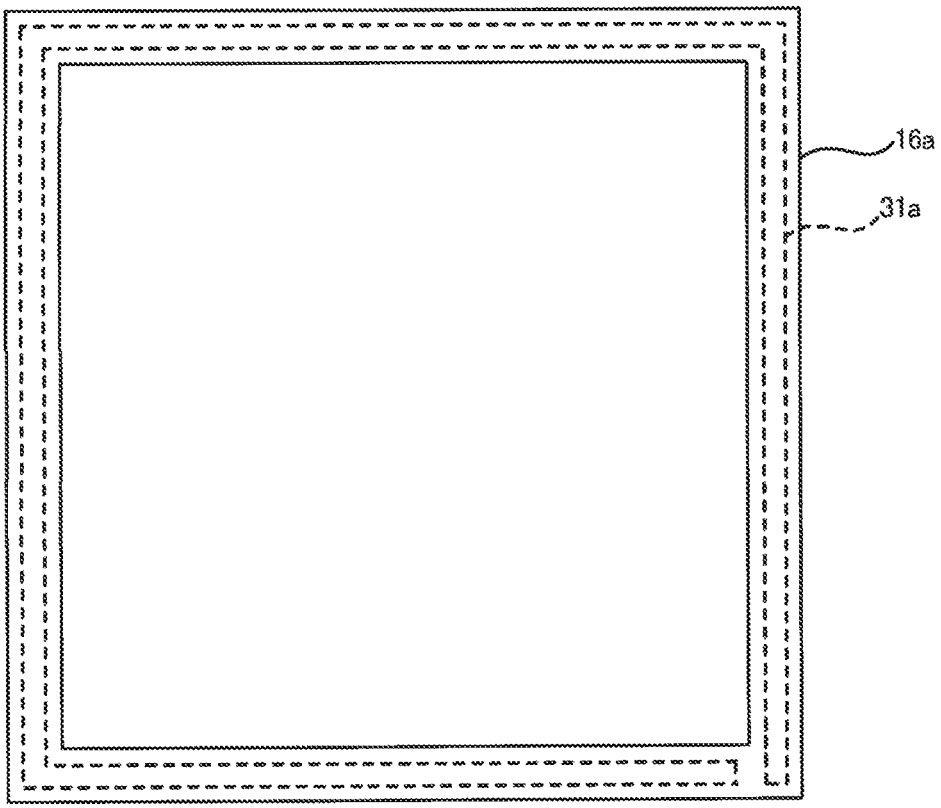
FIG. 14 is a plan view explaining another configuration of the antenna.

FIG. 13 is a schematic diagram explaining the configuration of an antenna in the case of employing a ring of rectangular frame shape (square shape) as a bezel 16*a*. When viewed in plan from the direction perpendicular to the display surface of the display, outer case is not a cylindrical shape, and in the case of the electronic apparatus of the watch having a rectangular tubular shape, the bezel 16*a* is also formed in a rectangular frame shape to match the outer case. For the antenna of the present disclosure, there is a need to strengthen the electromagnetic coupling between the bezel and the ribbon, such that the shape of the bezel and the shape of the ribbon are similar. Therefore, when the bezel 16*a* is formed in a rectangular frame shape, the shape of the ribbon 31*a* also becomes a shape in which a portion of the rectangular frame shape is cut away. The rectangular antenna electrode 33*a* and the power supply 32*a* are connected to one end of the ribbon 31*a*. An antenna 30*a* in this modification example includes a bezel 16*a*, a ribbon 31*a*, a power supply 32*a*, and an antenna electrode 33*a*. Even in this case, the ribbon 31*a* is arranged to overlap the ribbon 31*a* in a plan view as illustrated in FIG. 14.

The bezel may be the O-shaped ring or a ring of a rectangular frame shape as described above, and may be a C-shaped loop in which a portion of the O-shaped ring is cut away. In this case, the ribbon which is a loop element, and the C-shaped bezel which is a loop element are electromagnetically coupled. Alternatively, the bezel may be a rod shape. However, in the case of the rod shape, the electromagnetic coupling with the ring which is the loop element is considered to be weakened, and the sensitivity is considered to be reduced. Further, the axial ratio of circularly polarized waves is also considered to be deteriorated.

Moreover, the ribbon may be not only the C-shape, but also an L-shape.

Modification Example 2

In each of the above-described embodiments and modification example, the case has been described in which the bezel made of metal which is the second element is disposed on the case body of the outer case 2. However, the present disclosure is not intended to be limited to such a configuration. For example, the present disclosure is applicable to the case where the case body is made of a resin or the like and the bezel made of metal is accommodated in the inside of the case body as invisible from the outside.

Modification Example 3

In each of the above-described embodiments and modification examples, the case has been described in which the bezel made of metal is used as the first element. However, the present disclosure is not intended to be limited to such a configuration. For example, a metal ring such as a dial ring is stacked on the outer circumferential inner surface or the outer surface of the glass 13 or cover glass 84, or is bonded and fixed to the glass and integrated, or a metal film is formed and the metal ring or the metal film may be used as the first element. In addition, a metal ring such as dial ring is stacked on the outer peripheral side surface or the outer peripheral upper surface of the character plate 81 or the liquid crystal panel 21, or is bonded and fixed to the character plate or the liquid crystal panel, or a metal film is formed and the metal ring or the metal film may be used as the first element. It is possible to reduce the assembling work load of the wristwatch by integrating the first element with the cover glass, the character plate or the liquid crystal panel. Further, it is possible to reduce a variation in assembly of the first element to the outer case.

Modification Example 4

In each of the above-described embodiments and modification examples, the case has been described in which the antenna of the present disclosure receives GPS radio waves of 1.5 GHz, but the present disclosure is not intended to be limited to such a configuration. For example, it may be configured to receive radio waves of microwaves of a wavelength of 1 m to 100 μm and a frequency of 300 MHz to 3 THz.

Moreover, it may be configured to receive a radio wave corresponding to the standards such as Bluetooth (registered trademark) or Wi-Fi (registered trademark).

Modification Example 5

In each of the above-described embodiments and modification examples, the case has been described in which the equivalent electrical length of the bezel which is the first element and the ribbon which is second element is ¼ wavelength, but the present disclosure is not intended to be limited to such a configuration. For example, the equivalent electrical length may be an integral multiple of ¼ wavelength.

Modification Example 6

In each of the above-described embodiments and modification examples, a running watch and a GPS watch are illustrated as an example of the electronic apparatus of the present disclosure, but the present disclosure is not limited thereto. The present disclosure is applicable to various electric apparatuses that receive radio waves by the antenna and display information.

What is claimed is:

1. An electronic apparatus comprising:

a display;

a circuit board;

a first element without power feeding that is made of metal;

a second element which includes an antenna electrode connected to a ground of the circuit board and a power supply, wherein the first element is disposed above the circuit board along an axis perpendicular to a planar surface of the display where the display and the circuit board overlap, and the second element is disposed above the circuit board and below the first element along the axis, and wherein the second element is an inverted F antenna.

2. The electronic apparatus according to claim 1, wherein the first element and the second element are electromagnetically coupled without a radiation element between the first element and the second element.

3. The electronic apparatus according to claim 1, wherein the circuit board includes a signal pattern and a GND pattern, and wherein the power supply is connected to the signal pattern, and the antenna electrode is connected to the GND pattern.

4. The electronic apparatus according to claim 1, wherein when λ is a wavelength of the electric wave received from a satellite, an equivalent electrical length of the second element is shorter than λ/4.

5. The electronic apparatus according to claim 1, wherein the first element is an annular shape.

6. The electronic apparatus according to claim 1, wherein when λ is a wavelength of the electric wave received from a satellite, an equivalent electrical length after the first element and the second element are electromagnetically coupled is λ/4, or an integer multiple of λ/4.

7. The electronic apparatus according to claim 1, wherein the first element and the second element are disposed so as to overlap each other along the axis where the display and the circuit board overlap.

8. The electronic apparatus according to claim 1, wherein when d is a distance between the first element and the second element, $$0.5\ \text{mm} \le d \le 2.0\ \text{mm}$$

is satisfied.

9. The electronic apparatus according to claim 1, wherein when H1 is a distance between the circuit board and the first element along the axis, $$4.0\ \text{mm} \le H1 \le 8.0\ \text{mm}$$

is satisfied.

10. The electronic apparatus according to claim 1, wherein when λ is a wavelength of the electric wave received from a satellite, an equivalent electrical length of the second element is λ/4×about 0.7.

11. The electronic apparatus according to claim 1, wherein the first element is a bezel or a ring-shaped dial ring.

12. The electronic apparatus according to claim 1, wherein the second element receives microwaves from 300 MHz to 3 THz.

13. The electronic apparatus according to claim 1, wherein the second element is a circular arc shape.

14. The electronic apparatus according to claim 1, wherein the first element is an annular shape, a circular arc shape, or a rectangular frame shape.

15. The electronic apparatus according to claim 1, wherein the display is a digital-type or a pointer-type.

16. An electronic apparatus comprising:

a case body;

a bezel made of metal without power feeding is attached to the surface side of the case body;

a display;

a circuit board;

a receiver mounted on the circuit board;

an inverted F antenna mounted on the circuit board and connected to the receiver, wherein the inverted F antenna includes an antenna electrode connected to a ground of the circuit board and a power supply, and the bezel is disposed above the circuit board along an axis perpendicular to a planar surface of the display where the display and the circuit board overlap, and the inverted F antenna is below the bezel along the axis.

17. The electronic apparatus according to claim 16, wherein the bezel and the inverted F antenna are electromagnetically coupled.

18. The electronic apparatus according to claim 16, wherein the circuit board includes a signal pattern and a GND pattern, and wherein the power supply is connected to the signal pattern, and the antenna electrode is connected to the GND pattern.

19. The electronic apparatus according to claim 16, wherein the bezel is an annular shape.

20. The electronic apparatus according to claim 16, wherein when λ is a wavelength of the electric wave received from a satellite, an equivalent electrical length after the bezel and the inverted F antenna are electromagnetically coupled is λ/4, or an integer multiple of λ/4.

21. The electronic apparatus according to claim 16, wherein the bezel and the inverted F antenna are disposed so as to overlap each other along the axis where the display and the circuit board overlap.

22. The electronic apparatus according to claim 16, wherein when d is a distance between the bezel and the inverted F antenna along the axis, $$0.5\ \text{mm} \leq d \leq 2.0\ \text{mm}$$

is satisfied.

23. The electronic apparatus according to claim 16, wherein when H1 is a distance between the circuit board and the bezel along the axis, $$4.0\ \text{mm} \leq H1 \leq 8.0\ \text{mm}$$

is satisfied.

24. The electronic apparatus according to claim 16, wherein when λ is a wavelength of the electric wave received from a satellite, an equivalent electrical length of the inverted F antenna is λ/4×about 0.7.

25. The electronic apparatus according to claim 16, wherein the inverted F antenna is a circular arc shape.

26. The electronic apparatus according to claim 16, wherein the bezel is an annular shape, a circular arc shape, or a rectangular frame shape.

* * * * *